US005542321A

United States Patent [19]

Fuca

[11] Patent Number: 5,542,321

[45] Date of Patent: Aug. 6, 1996

[54] BASIN WRENCH FOR PLASTIC NUTS

[76] Inventor: Albert F. Fuca, 4416 Clovercrest La., Rockford, Ill. 61109

[21] Appl. No.: 390,059

[22] Filed: Feb. 17, 1995

[51] Int. Cl.[6] ..... B25B 13/00

[52] U.S. Cl. ..... 81/125.1; 81/124.2

[58] Field of Search ..... 81/121.1, 124.2, 81/124.4, 125.1

[56] References Cited

U.S. PATENT DOCUMENTS 5,048,378 9/1991 Nikolas ..... 81/124.2
5,050,463 9/1991 Stielow ..... 81/63

FOREIGN PATENT DOCUMENTS 2364741 5/1978 France ..... 81/125.1
574032 12/1945 United Kingdom ..... 81/124.4

*Primary Examiner*—Bruce M. Kisliuk
*Assistant Examiner*—Joni B. Danganan
*Attorney, Agent, or Firm*—Leydig, Voit & Mayer, Ltd.

[57] ABSTRACT

The wrench is formed by a cylindrical sleeve having one end portion of relatively large inside diameter and a second end portion of smaller inside diameter. The larger end portion of the sleeve is formed with four angularly spaced notches which enable the wrench to be used to turn plastic nuts having either two or four wrenching wings. The smaller end portion of the sleeve is formed with six angularly spaced notches and may be used to turn either hex nuts or nuts having between two and six wrenching lugs.

3 Claims, 2 Drawing Sheets

BASIN WRENCH FOR PLASTIC NUTS

BACKGROUND OF THE INVENTION

The invention relates to a wrench for use in plumbing applications and, more particularly, to a basin wrench for tightening and loosening nuts used to secure kitchen and vanity faucets, kitchen spray hoses, toilet ballcocks and the like. Such nuts usually are located in difficult-to-reach and confined areas making it cumbersome to engage a wrench with the nuts and to turn the nuts.

A typical basin wrench has a fixed jaw, a hinged jaw and an elongated handle for turning the jaws after the jaws have been clamped onto the nut. Even these wrenches are difficult to engage with the nut and, if the wrench slips, the plumber often is in danger of injuring his or her knuckles or other parts of the hand.

In recent years, plastic nuts rather than brass nuts have been widely used to secure faucets, ballcocks and the like. Many plastic nuts have wings or flanges to facilitate turning of the nuts by hand. In many cases, however, it still is necessary to use a wrench with such nuts to insure tightness and also to loosen nuts which may have become "frozen" in place either through over-tightening or as a result of minerals in the water.

SUMMARY OF THE INVENTION

The general aim of the present invention is to provide an extremely simple basin wrench which may be used in a very quick and easy manner to tighten and loosen plastic nuts.

A more detailed object of the invention is to achieve the foregoing by providing a basin wrench in the form of a simple sleeve having a notched end enabling the wrench to be used to turn either winged nuts or hex nuts.

Still another object is to provide a double-ended, sleeve-type basin wrench capable of being used with nuts of several different sizes and types.

These and other objects and advantages of the invention will become more apparent from the following detailed description when taken in conjunction with the accompanying drawings.

Figure 1:
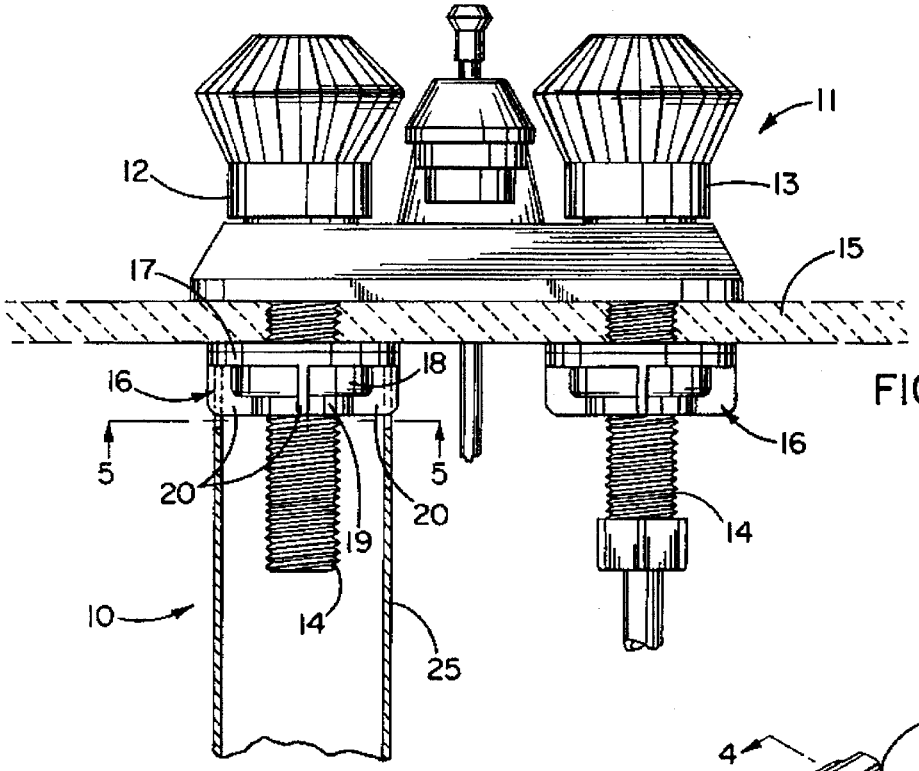
FIG. 1 is an elevational view of a typical vanity faucet and shows one of the nuts of the faucet being engaged by a new and improved basin wrench incorporating the unique features of the present invention.
Figure 2:
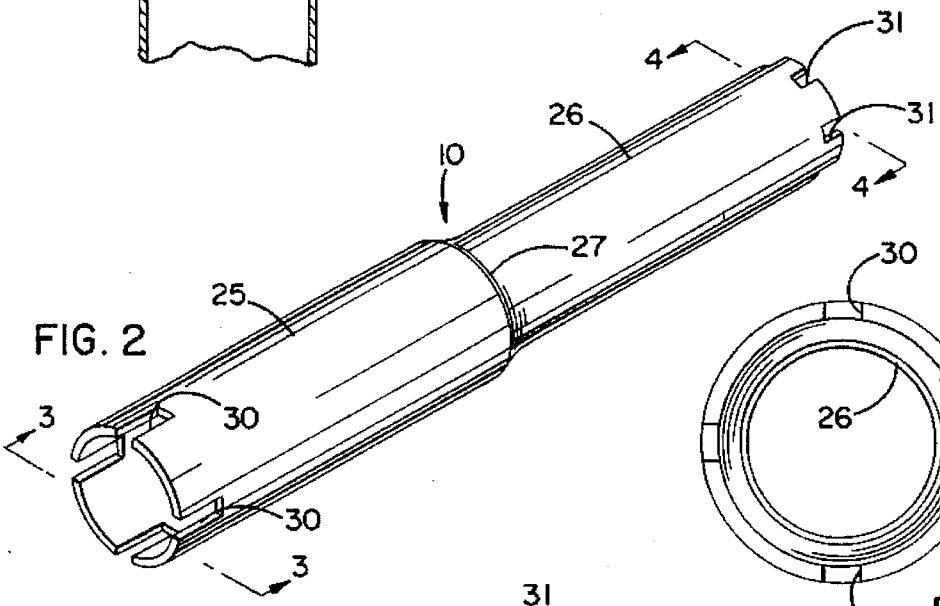
FIG. 2 is a perspective view of the basin wrench.
Figure 3:
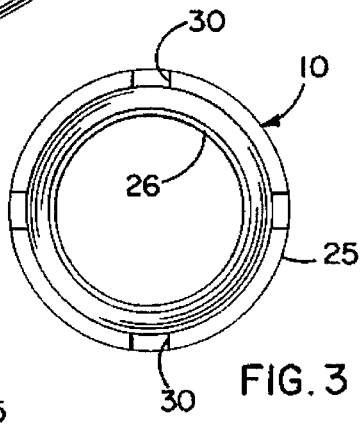
FIG. 3 is an end view of one end of the wrench as seen in the direction of the arrows of the line 3—3 of FIG. 2.
Figure 4:
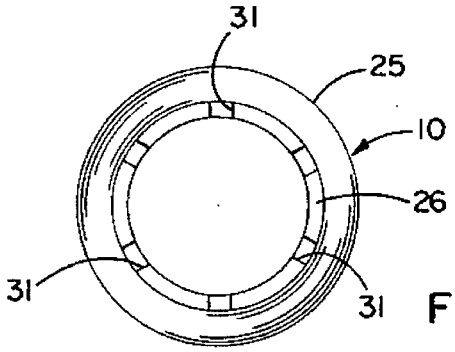
FIG. 4 is an and view of the opposite end of the wrench as seen in the direction of the arrows of the line 4—4 of FIG. 2.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as incorporated in a basin wrench 10 adapted to be used by a plumber to tighten and loosen various types of plastic nuts such as used in conjunction with kitchen and vanity faucets, kitchen spray hoses, toilet ballcocks and other plumbing fixtures. A typical vanity faucet unit 11 has been shown in FIG. 1 and includes hot and cold faucets 12 and 13 having threaded shanks 14 which are inserted downwardly through holes in the countertop 15. The faucet unit is clamped to the countertop by nuts 16 threaded on the shanks 14. Herein, each nut is plastic and includes an upper flange 17, a tubular midportion 18, and a smaller diameter lower end portion 19 which is internally threaded to receive the shank. Four angularly spaced wings 20 are molded integrally with the flange 17 and with the nut portions 18 and 19 and may be used to turn the nut. The particular nut which has been shown is an industry standard nut and its tubular midportion 18 has an outside diameter of about 1⅜". The radial spacing between the free edges of diametrically opposed wings 20 is about 1¾".

The present invention contemplates a new and improved basin wrench 10 which is of simple and inexpensive construction, which is quick, easy and convenient to use, and which may be used with plastic nuts of various types and sizes. The wrench 10 is particularly characterized by its ability to be slipped over a nut in confined locations (e.g., the space immediately below a faucet) and to be easily turned in order to tighten or loosen the nut.

In carrying out the invention, the wrench 10 is formed by a simple sleeve having an end portion 25 with a first predetermined diameter and an end portion 26 of a second and different predetermined inside diameter. Herein, the end portion 25 of the sleeve 10 is formed by a length of steel pipe approximately 5" long and having a wall thickness of about 1/16". The end portion 25 is cylindrical over most of its length and has an inside diameter of about 1½".

The end portion 26 of the sleeve 10 also is formed by a 5" length of cylindrical steel pipe which, in this instance, has an inside diameter of about 1⅛". The two pipes defining the end portions 25 and 26 are telescoped together near adjacent ends and then are welded to one another at 27. In order to enable such welding, the welded end portion of the pipe 25 is necked down to a diameter matching the outside diameter of the pipe 26.

Pursuant to the invention, angularly spaced notches 30 and 31 are formed in the free ends of the end portions 25 and 26, respectively, of the sleeve 10. Herein, four equally spaced and generally U-shaped notches 30 are formed through the end portion 25 and open axially out of the end thereof. Each notch 30 has a circumferential width of about 3/16" and a depth of about ½". Six equally spaced and generally U-shaped notches 31 are formed through the end portion 26 and open axially out of the end of such end portion. The notches 31 also have a circumferential dimension of about 3/16" but are shallower than the notches 30 and have a depth of only about ¼".

Figure 5:
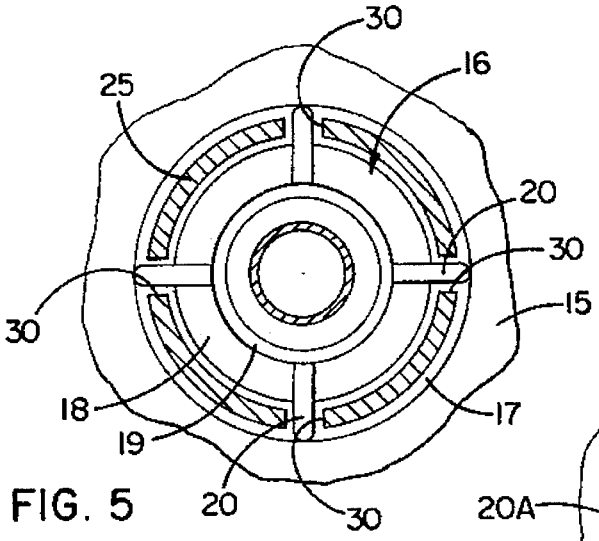
FIG. 5 is an enlarged fragmentary cross-section taken substantially along the line 5—5 of FIG. 1.

To use the wrench 10 on the nut 16 shown in FIGS. 1 and 5, the end portion 25 of the wrench is simply slipped upwardly over the shank 14 and is telescoped onto the tubular midportion 18 of the nut. As an incident thereto, the four notches 30 slide onto and receive the four wings 20. The depth of the notches 30 is such that the wings are fully received in the notches but do not bottom against the notches when the extreme end of the wrench is in engagement with the flange 17 of the nut. With the wrench and the nut coupled by virtue of the notches and the wings, the nut may be tightened or loosened simply by turning the wrench by hand about its own axis.

Figure 6:
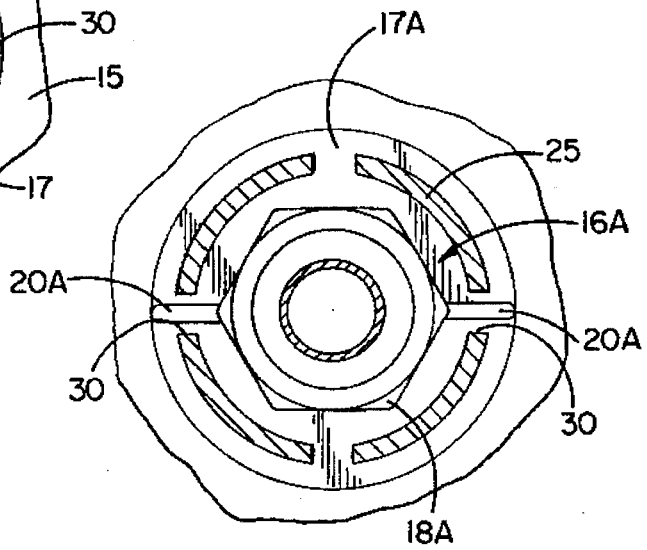
FIGS. 6–8 are sectional views similar to FIG. 5 but show the wrench applied to nuts of different types and sizes.

FIG. 6 shows the end portion 25 of the wrench 10 in connection with a different type of nut 16A having a flange 17A, a hexagonal threaded portion 18A, and two diametrically spaced wings 20A. In use of the wrench with the nut 16A, the hexagonal portion 18A is received within the end portion 25 of the wrench while the two wings 20A are received in two diametrically spaced notches 30 so as to effect turning of the nut upon turning of the wrench.

Figure 7:
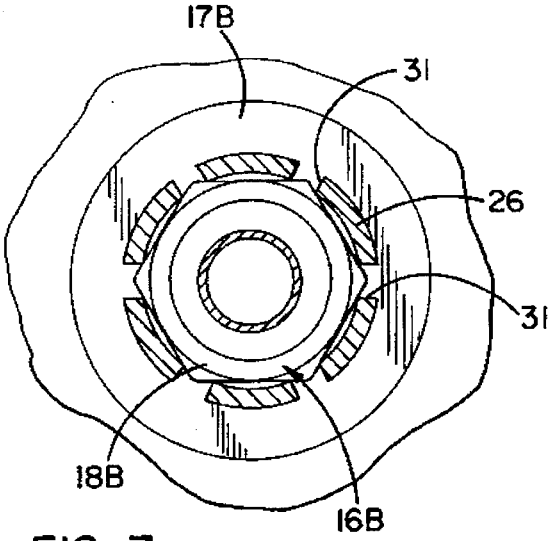

In FIG. 7, the smaller end portion 26 of the wrench 10 is shown in conjunction with a nut 16B having a flange 17B and having a wingless hexagonal threaded portion 18B with a dimension of about 1 1/16" across its flats and with a dimension of about 1 3/8" across its points. The smaller end portion 26 of the wrench 10 is telescoped onto the hexagonal portion 18B of the nut and, as an incident thereto, the triangular points of the hexagonal portion enter into and become coupled with the notches 31. Thus, the side walls of the notches coact with the triangular points to cause the nut to turn in unison with the wrench.

Figure 8:
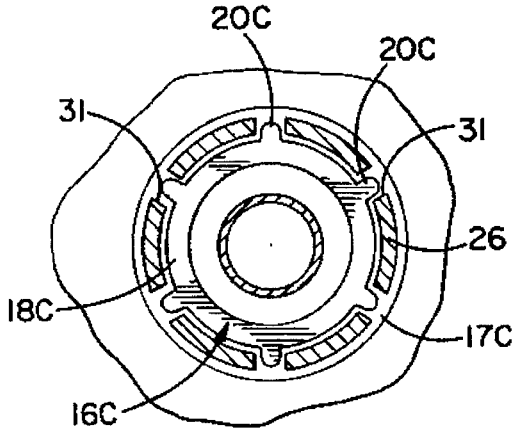

FIG. 8 shows the small end portion 26 of the wrench 10 used with a nut 16C having a flange 17C and a cylindrical threaded portion 18C formed with six angularly spaced and relatively short lugs 20C. As the end portion 26 telescopes over the cylindrical portion 18C, the notches 31 embrace the lugs 20C so as to enable the wrench to effect turning of the nut.

From the foregoing, it will be apparent that the present invention brings to the art a simple, versatile and easy-to-use basin wrench for tightening and loosening plastic nuts. Plumbers greatly prefer the present wrench over conventional basin wrenches because of the ease of engaging the wrench with the nut and because there is very little danger of the wrench slipping off of the nut and causing injury to the hand. The specific diameters of the end portions 25 and 26 and the specific number of notches 30 and 31 formed in the end portions enable the wrench to be used with a variety of standard nuts which are merely hexagonal or which include wings, lugs or other wrenching aids.

I claim:

1. A double-ended sleeve-type basin wrench for tightening and loosening plastic nuts on elongated threaded shanks of plumbing fixtures, said wrench comprising an elongated tubular sleeve of circular cross-section and having a first end portion with an inside diameter of about 1½ inches, four equally and angularly spaced notches formed through the first end portion of said sleeve and opening out of the end of said first end portion, said sleeve having a second end portion with an inside diameter of about 1⅛ inches, and six equally and angularly spaced notches formed through the second end portion of said sleeve and opening out of the end of said second end portion, a continuous internal bore from end to end of the sleeve and having a minimum internal diameter no smaller than the second end portion, and the external surface of the tubular sleeve serving as the sole means for turning the wrench by hand to tighten or loosen said plastic nuts, said first end portion of said sleeve being formed by a first length of tubular pipe having an inside diameter of approximately 1½ inches, said second end portion of said sleeve being formed by a second length of tubular pipe having an inside diameter of approximately 1⅛ inches, said pipes having end portions welded to one another without obstructing the continuity of the internal bore.

2. A wrench as defined in claim 1 in which the welded end portion of one of said pipes is of different diameter than the main length of the pipe to enable welding of the pipes.

3. A wrench as defined in claim 2 in which the welded end portion of said first pipe is smaller in diameter than the main length of said first pipe to enable said first pipe to be welded to said second pipe.

* * * * *